US007182831B2

(12) United States Patent
Roll

(10) Patent No.: US 7,182,831 B2
(45) Date of Patent: Feb. 27, 2007

(54) METHOD AND DEVICE FOR MOISTENING FIBROUS RAW MATERIALS WITH BINDING AGENTS

(75) Inventor: Helmut Roll, Krefeld (DE)

(73) Assignee: Metso Paper, Inc. (FI)

( * ) Notice: Subject to any disclaimer, the term of this patent is extended or adjusted under 35 U.S.C. 154(b) by 348 days.

(21) Appl. No.: 10/448,901

(22) Filed: May 30, 2003

(65) Prior Publication Data

US 2004/0026004 A1 Feb. 12, 2004

(30) Foreign Application Priority Data

May 31, 2002 (DE) ..... 102 24 090

(51) Int. Cl.
*B27N 3/04* (2006.01)

(52) U.S. Cl. ..... 156/296; 118/303; 427/207.1; 427/212; 427/222; 427/421

(58) Field of Classification Search ..... None
See application file for complete search history.

(56) References Cited

U.S. PATENT DOCUMENTS

| | | | | | |
|---|---|---|---|---|---|
| 2,549,563 | A * | 4/1951 | Barnstead | 106/619 |
| 3,383,274 | A * | 5/1968 | Craig | 428/326 |
| 3,874,990 | A * | 4/1975 | Surdyk | 428/528 |
| 4,104,429 | A * | 8/1978 | Colledge | 428/151 |
| 4,116,163 | A * | 9/1978 | Torelli et al. | 118/303 |
| 4,478,896 | A * | 10/1984 | Barnes et al. | 427/212 |
| 5,185,115 | A | 2/1993 | Thole | |
| 5,695,599 | A * | 12/1997 | Pankoke | 156/555 |
| 5,792,264 | A * | 8/1998 | Frati | 118/303 |
| 6,312,632 | B1 * | 11/2001 | Graf | 264/119 |
| 6,479,002 | B1 | 11/2002 | Becker et al. | |

FOREIGN PATENT DOCUMENTS

| | | |
|---|---|---|
| DE | 36 41 466 | 6/1988 |
| DE | 39 30 840 | 3/1991 |
| DE | 198 60 836 | 5/2000 |
| DE | 199 56 418 | 5/2001 |

* cited by examiner

*Primary Examiner*—Sam Chuan Yao
(74) *Attorney, Agent, or Firm*—Cantor Colburn LLP

(57) ABSTRACT

The disclosure includes a method for gluing fibrous raw materials, which improves the even distribution of the binding agent on the fibers considerably. The disclosure furthermore describes a device for performing the gluing process. The disclosure suggests a method for moistening fibrous raw materials provided for the manufacture of fiberboards, mats and the like with bonding agents, wherein the fibrous raw materials exist in at least a pre-dried state and are moistened by a pre-dispersed binding agent in a continuous stream, and wherein subsequent to the moistening process the fibrous raw materials are compressed with high pressure before being conveyed further.

5 Claims, 1 Drawing Sheet

METHOD AND DEVICE FOR MOISTENING FIBROUS RAW MATERIALS WITH BINDING AGENTS

FIELD OF THE INVENTION

The present invention relates to a method and a device for moistening fibrous raw materials provided for the manufacturing of fiberboards, mats and the like with binding agents, wherein the fibrous raw materials exist in at least a partially dried state.

The methods and devices pursuant to the invention in particular relate to such used for the moistening of fibrous raw materials with binding agents. The invention relates especially to the gluing of dried fibers for medium density fiberboard (MDF) manufacturing.

DESCRIPTION OF THE RELATED ART

The fibers used in MDF manufacturing are usually glued in the line between refiner and dryer. This means that the fibers are wet or not dried during the gluing process. After gluing, the fibers are exposed to heat in the dryer. Since the binding agents, preferably synthetic resins, used for MDF manufacturing are thermosetting, the effectiveness of the binding agent is impaired considerably by the heat occurring during the drying process. We also know of systems in which dried or pre-dried fibers are glued. Such dry fiber gluing processes employ mechanical fiber gluing machines, pneumatic transport lines or combinations thereof, wherein however mechanical gluing machines are most commonly used.

Such mechanical gluing machines usually consist of an elongated drum-shaped housing, which on one end comprises a vertical fiber inlet and on the other end a vertically to horizontally inclined fiber outlet. In the longitudinal axis of the drum-shaped housing a shaft with mixing (conveying) paddles is arranged. To the fibers dropping substantially vertically into the housing, a binding agent is applied through resin that is atomized e.g. with spray cans on the housing entrance end, they are then transported through the housing to the other end and are suctioned out off the housing there. The housings are generally equipped with cooled walls. This is the most broadly used mechanical gluing device for gluing dry fibers.

While in the area of wet fiber gluing in lines between the refiner and dryer good results are being achieved, leading to high quality medium density fiberboards, the subsequent fiber drying apparatus, as already mentioned above, decreases the binding agent's effectiveness. The decreased binding agent effectiveness must be compensated with increased binding agent dosages to achieve comparable firmness properties in the medium density fiberboards produced from glued fibrous materials. Since the binding agent costs represent a considerable portion of the overall production costs, higher binding agent dosages during the gluing of non-dried fibers in the lines have a considerable effect on the economical aspects of the MDF manufacturing process compared to the gluing of dried fibers.

However all existing known gluing techniques for dried fibers have the disadvantage that the adhesive is distributed unevenly among the fibers. This leads on one hand to glue stains, and on the other hand to insufficiently glued areas in the finished boards. This impairs both the visual properties of the accordingly produced boards and in part also the mechanical-physical and processing properties.

From the field of particle-board manufacturing it is known that the particles that are to be glued are subjected to a mixing process after the primary moistening process with adhesive so that the adhesive distribution on and between the particles is influenced quite considerably also by the subsequent secondary mutual rubbing of the particles against each other and against the solid equipment components (wiping effect). This mixing process cannot be performed with fibers. Due to their considerably lower bulk density compared to wood particles (and due to their tendency to form fibrous conglomerates), according to existing state of the art, a mixing of the fibers that have been primarily moistened with adhesive does not lead to a considerably higher distribution of the adhesive.

SUMMARY OF THE INVENTION

The invention includes a method for gluing fibrous raw materials, which considerably improves the even distribution of the binding agent on the fibers. The invention furthermore shall provide a device for performing the gluing process.

From a procedural point of view, the invention suggests for the technical solution a method for moistening fibrous raw materials that are provided for the production of fiberboards, mats and the like with binding agents, wherein the fibrous raw materials exist in at least a pre-dried state and are moistened by an atomized binding agent in a continuous stream, characterized in that the continuous fibrous raw material flow, which is moistened primarily with adhesive, subsequent to the moistening process is compressed at high pressure before being transported further.

Compression in the sense of the present invention means that compared to the original fiber bulk density the fibers are guided such that more fibers per volume are combined. It is common practice in the industry to operate conventional mixing devices pursuant to the state of the art with about 5 to 10 tons of fiber through-put per hour. The usual non-compressed bulk density is 15 to 30 kg/m$^3$. The invention allows a doubling of the fiber through-put without difficulty, while the uniformity of the gluing process is increased considerably.

Pursuant to the invention, continuous partial fiber streams are compressed at great pressure after they have been transported away from the adhesive moistening area before they are transported further. This causes the fibers to perform movements relative to and in contact with each other so that frictional forces are created, due to which the gluing agent is distributed more evenly and which cause the wiping effect between the individual fibers.

With the invented application, a considerably improved adhesive distribution level is achieved on and between the fibers, leading to savings of adhesive material and better board quality.

As a beneficial feature, the invention suggests guiding partial streams of glued fibers into each other. This creates the necessary compression and the relative movements with great effect. Beneficially, the partial streams are moistened separately with adhesive. This increases not only the gluing effectiveness, but at the same time also the production quantity. Pursuant to another beneficial suggestion of the invention, after compression the fibers are transported further through a suction process. Due to the impact of the partial fiber currents with each other at great pressure, at the same time potential fiber conglomerates or covered fiber ball are largely dissolved.

The method pursuant to the invention increases the qualitative production results to a considerable degree. Gluing of the fibers becomes substantially more even, and fiber conglomerates are avoided.

From a device point of view, the invention suggests a device for moistening fibrous raw materials provided for the production of fiberboards, mats and the like with binding agents, wherein the fibrous raw materials exist in at least a partially dried state. The device consists of a feeding shaft, a moistening section, a conveying section and an output shaft and is characterized in that between the conveying section and the output shaft a compression station is arranged.

This invented device enables even gluing of dried fibers for MDF manufacturing.

Pursuant to a beneficial suggestion, the device contains at least two feeding areas, moistening areas and conveying sections, respectively. Both conveying sections end in a joint collecting region in front of the joint output shaft. In the collecting region the compression process and relative movement of the partial streams take place. Since they were moistened separately, the overall through-put of the device can be selected to be very high.

Beneficially both partial streams are guided 180° opposite from each other. This optimizes the compression/relative movements.

Pursuant to a beneficial suggestion of the invention, the device comprises a mixing tub consisting of a substantially cylindrical/barrel-shaped cross-section. This favors a conveying process that is free from caking.

The moistening section beneficially comprises a suitable adhesive spraying or atomization apparatus, such as e.g. nozzles, so that the partial fiber streams are moistened with droplets of adhesive as evenly as possible.

The conveying section beneficially comprises a mixing shaft, which rotates concentrically in the mixing tub and is equipped with mixing tools.

BRIEF DESCRIPTION OF THE DRAWINGS

Further benefits and features of the invention result from the following description based on the figure. It shows.

DETAILED DESCRIPTION

Figure 1:
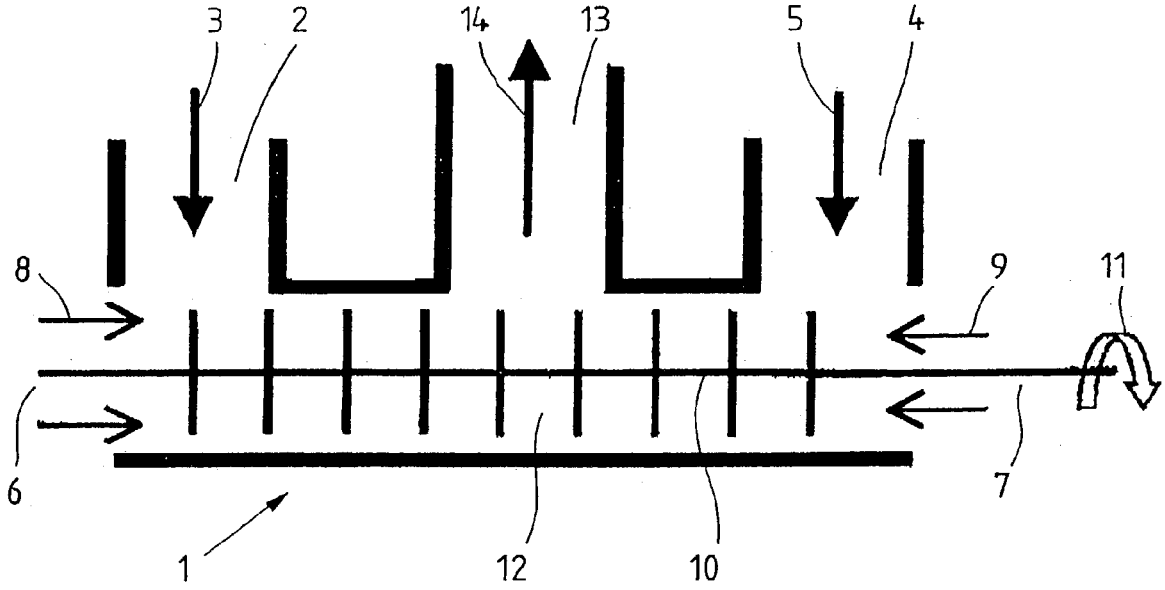
FIG. 1 a diagrammatic sectional view of a mechanical gluing device

Pursuant to FIG. 1, the invented mechanical gluing device 1 has a substantially barrel-shaped cross-section, which is not shown. Via a vertical inlet shaft 2 a fiber stream 3 of at least pre-dried fibers is introduced. On the opposite end, another stream of dried fibers 5 is introduced via an inlet shaft 4. Both on the end 6 and on the end 7 of the device 1 suitable adhesive spraying or atomization apparatuses (not shown) are arranged, which pre-disperse the binding agent and feed it into the device. This is indicated with arrows 8, 9. The glued fibers are then conveyed to the center by means of a rotating mixing shaft 10, which is equipped with suitable mixing tools. The rotation of the mixing shaft is indicated by the directional arrow 11. The two partial fiber streams essentially meet with one other in the area 12, wherein this collision area can also comprise the adjacent areas and also the area above. The glued fibers are then suctioned off via an output shaft 13, for example, through a negative pressure environment, which is indicated by the material flow arrow 14.

The length of the drum was set at 5,500 mm with a drum diameter of 1,100 mm. The fiber inlet had a cross-section of 1,000 times 350 $mm^2$. With this system the positive advantages pursuant to the invention were achieved.

The described example of a design serves only the explanation of the invention and does not limit it.

| Legend | |
|---|---|
| 1 | Gluing Device |
| 2 | Feeding Shaft |
| 3 | Fiber Stream |
| 4 | Feeding Shaft |
| 5 | Fiber Stream |
| 6 | Spraying or Atomization Device |
| 7 | Spraying or Atomization Device |
| 8 | Pre-Dispersed Binding Agent |
| 9 | Pre-Dispersed Binding Agent |
| 10 | Mixing Shaft |
| 11 | Direction of Rotation |
| 12 | Collision Area |
| 13 | Output Shaft |
| 14 | Output Stream |

The invention claimed is:

1. Method for providing fibrous raw material with a bonding agent, the fibrous material being intended for the manufacture of fiberboards, mats and the like, the method comprising:

providing a continuous flow of the fibrous material;

moistening said flow of fibrous material wit a bonding agent;

compacting the flow of fibrous material in order to provide movement of the fibers against each other so that equalizing of the bonding agent on and between the fibers is achieved; and conveying said flow of fibrous material to a shaping station in order to manufacture the fibreboards, mats and the like.

2. Method pursuant to claim 1, further comprising providing a plurality of flows of the fibrous material to be provided with said bonding agent.

3. Method pursuant to claim 2, further comprising moistening separately each of said plurality of flow of the fibrous material with said bonding agent.

4. Method pursuant to claim 2, further comprising forming a single flow of fibrous material provided with said bonding agent from said plurality of flows of fibrous material to be provided with said bonding agent.

5. Method pursuant to claim 2, further comprising forming a single flow of fibrous material provided with said bonding agent during the compacting the flow of fibrous material.

* * * * *